US007040287B2

(12) United States Patent
Steffen

(10) Patent No.: US 7,040,287 B2
(45) Date of Patent: May 9, 2006

(54) FUEL DOSAGE DEVICE

(75) Inventor: Michael Steffen, München (DE)

(73) Assignee: Wacker Construction Equipment AG, Munich (DE)

( * ) Notice: Subject to any disclaimer, the term of this patent is extended or adjusted under 35 U.S.C. 154(b) by 38 days.

(21) Appl. No.: 10/489,267

(22) PCT Filed: Dec. 4, 2002

(86) PCT No.: PCT/EP01/13747

§ 371 (c)(1),
(2), (4) Date: Mar. 9, 2004

(87) PCT Pub. No.: WO03/052257

PCT Pub. Date: Jun. 26, 2003

(65) Prior Publication Data

US 2004/0244775 A1 Dec. 9, 2004

(30) Foreign Application Priority Data

Dec. 14, 2001 (DE) ..... 101 61 586

(51) Int. Cl.
*F02M 7/00* (2006.01)

(52) U.S. Cl. ..... 123/438; 123/513; 123/677

(58) Field of Classification Search ..... 123/513, 123/677, 438

See application file for complete search history.

(56) References Cited

U.S. PATENT DOCUMENTS 4,086,890 A * 5/1978 Minami et al. ..... 123/677
4,212,065 A * 7/1980 Marchak et al. ..... 701/104
4,349,877 A * 9/1982 Oyama et al. ..... 701/104
4,411,232 A * 10/1983 Atago et al. ..... 123/438
4,416,239 A * 11/1983 Takase et al. ..... 123/406.47
4,787,356 A * 11/1988 Rosgen et al. ..... 123/438
5,632,248 A * 5/1997 Sugii ..... 123/438
6,581,916 B1 * 6/2003 Shaw ..... 261/35

FOREIGN PATENT DOCUMENTS

DE 36 21 497 A 1/1988
DE 38 23 525 A 1/1990
DE 43 28 989 A 3/1995
DE 199 13 073 A 10/2000

* cited by examiner

*Primary Examiner*—Erick Solis
(74) *Attorney, Agent, or Firm*—Boyle Fredrickson Newholm Stein & Gratz S.C.

(57) ABSTRACT

The invention relates to a fuel metering device comprising a fuel chamber, a fuel inlet which can be opened and closed and leads to the fuel chamber, and at least one fuel outlet leading from the fuel chamber to a suction channel of an internal combustion engine. Part of a wall of the fuel chamber consists of a first element which can be moved according to a pressure difference between a pressure in the fuel chamber and an ambient air pressure, the element being coupled to a closing element for opening and closing the fuel inlet. The said fuel metering device enables a quantity of fuel, which is supplied to the suction channel for a predefined operating position of the internal combustion engine, to be automatically regulated according to the ambient air pressure.

12 Claims, 3 Drawing Sheets

FUEL DOSAGE DEVICE

BACKGROUND OF THE

1. Field of the Invention

The invention relates to a fuel-metering device according to the preamble of claim 1/3.

2. Description of the Related Art

Fuel-metering devices of this type are typically used as diaphragm carburettors for internal combustion engines. In the case of a diaphragm carburettor, a negative pressure produced during the intake procedure in an intake channel or a crank chamber serves to displace a movable diaphragm, thus causing a fuel stop to open and fresh fuel to flow into a fuel chamber. From the fuel chamber, the fuel flows via control devices and nozzles, which are known per se, into the intake channel where it is mixed with air also flowing in and finally is guided as a fuel-air mixture into a combustion chamber. In addition to other specific variables of the carburettor, the deflection of the diaphragm determines the quantity of fuel delivered in each case. The engine speed and the quantity of fuel delivered are approximately in proportion, since at a high engine speed a substantial quantity of fuel is taken in for each unit of time, whereas at a low engine speed and a correspondingly reduced number of strokes a smaller amount of flow flows.

DE 199 13 073 C2 discloses a fuel-metering device, wherein the position and/or the mobility of the movable element which is formed e.g. by a diaphragm can be influenced by an active control element, the controller of which is coupled to an ignition device of an internal combustion engine. In this way, where an ignition pulse is omitted, it is possible to reduce or even completely prevent excess fuel from being supplied into the intake channel of the internal combustion engine.

During the operation of internal combustion engines, to which the fuel-air mixture is supplied via a carburettor, the stoichiometrically correct composition of the fuel-air mixture is an important prerequisite for complete combustion, optimum engine performance and beneficial exhaust gas behaviour of the engine.

The concentration of oxygen per volume percentage of air is generally dependent upon the respective altitude, at which an internal combustion engine is utilised, wherein the oxygen concentration decreases at relatively high altitudes. Accordingly, the performance of the internal combustion engine during usage at relatively high altitudes is diminished owing to the reduced oxygen concentration and a deviation from the stoichiometrically correct composition of the fuel-air mixture which this causes. This makes it necessary to readjust the carburettor to adapt to the different altitude, in order to restore the optimum fuel-air ratio to be supplied to the internal combustion engine.

In this connection, reference may be made to documents DE-A-199.13.073 and DE-36.21.497.

OBJECTS AND SUMMARY OF THE INVENTION

It is the object of the invention to provide a fuel-metering device, by means of which internal combustion engines can be operated in such a manner as to be adapted automatically to suit different altitudes at which they are utilised.

In accordance with the invention, the object is achieved by a fuel-metering device in accordance with claims 1 and 3. Advantageous developments are described in the dependent claims.

A fuel-metering device in accordance with a first aspect of the invention comprises a fuel chamber, a fuel inlet which can be opened and closed and leads to the fuel chamber, and at least one fuel outlet leading from the fuel chamber to an intake channel of an internal combustion engine, wherein part of a wall of the fuel chamber consists of a first element which can be moved depending upon a pressure difference between a pressure in the fuel chamber and an ambient air pressure, said element being coupled to a closing element for opening and closing the fuel inlet. In a position opposite the first movable element a second movable element is disposed which can be moved in dependence upon a change in the ambient air pressure and in the direction of the first movable element. A first magnetic portion is attached to the first movable element and a second magnetic portion is attached to the second movable element. In the event of a decrease in the ambient air pressure the second movable element is moved closer to the first movable element in such a manner as to intensify a magnetic interaction between the first magnetic portion and the second magnetic portion, as a result of which the first movable element can be set in motion in dependence upon the ambient air pressure in order to actuate the closing element, so that a quantity of fuel which is to be supplied to the intake channel for a predetermined operating position of the internal combustion engine can be regulated in dependence upon the ambient air pressure.

A fuel-metering device in accordance with a second aspect of the invention comprises a fuel chamber, a fuel inlet which can be opened and closed and leads to the fuel chamber, and at least one fuel outlet leading from the fuel chamber to an intake channel of an internal combustion engine, wherein part of a wall of the fuel chamber consists of a first element which can be moved depending upon a pressure difference between a pressure in the fuel chamber and an ambient air pressure, said element being coupled to a closing element for opening and closing the fuel inlet. Furthermore, the fuel-metering device comprises a through-flow regulating device for adjusting the supply of fuel to the intake channel, an adjusting device which can be coupled to the through-flow regulating device, a pressure detection device for detecting a change in the ambient air pressure and a control device which in dependence upon the pressure detection device serves to operate the adjusting device for actuating the through-flow regulating device. The through-flow regulating device comprises a nozzle needle in a passage between the fuel chamber and the intake channel, wherein a position of the nozzle needle in the passage can be changed by means of the adjusting device which can be operated by the control device, so that a quantity of fuel which is to be supplied to the intake channel for a predetermined operating position of the internal combustion engine can be regulated in dependence upon the ambient air pressure.

A common aspect of the two embodiments of the fuel-metering device in accordance with the invention is that a quantity of fuel which is to be supplied to the intake channel for a predetermined operating position of the internal combustion engine can be regulated in dependence upon the ambient air pressure.

A substantial advantage of the fuel-metering device in accordance with the invention resides in the fact that the changeability of the composition of air in each case in dependence upon a corresponding altitude is compensated for automatically by a quantity of fuel supplied accordingly, so that the internal combustion engine is always only supplied with the amount of fuel required for stoichiometrically correct combustion.

The fuel-metering device in accordance with the invention is provided with a through-flow regulating device for adjusting the supply of fuel to the intake channel, an adjusting device which can be coupled to the through-flow regulating device, and with a pressure detection device for detecting a change in the ambient air pressure. Furthermore, the fuel metering device comprises a control device which, in dependence upon the pressure detection device, serves to operate the adjusting device in order to actuate the through-flow regulating device.

In the case of the fuel-metering device in accordance with the second aspect of the invention, the pressure detection device comprises a nozzle needle in a passage between the fuel chamber and the intake channel as the through-flow regulating device, wherein it is possible to adjust a position of nozzle needle in the passage by means of the adjusting device which can be operated by the control device. In dependence upon the respective ambient air pressure which can be detected by the pressure detection device, such as e.g. a pressure sensor and the like, it is possible to adjust the nozzle needle e.g. by means of a digital signal of the control device, such that the composition of the mixture in the metering device assumes a stoichiometrically correct ratio.

In the case of the fuel-metering device in accordance with the first aspect of the invention, the through-flow regulating device comprises the closing device and the adjusting device comprises the first movable element. The first movable element is subjected to a pretensioning force which is dependent upon the ambient air pressure, wherein the first movable element is set in motion by virtue of a change in the pretensioning force and as a consequence the closing element is actuated.

In this case, the pretensioning force is based upon a magnetic interaction. In this case, the first movable element can have a second element disposed opposite thereto which can be moved in dependence upon a change in the ambient air pressure and in the direction of the first movable element. Furthermore, the first movable element and also the second movable element can have a first and second magnetic portion respectively attached thereto, wherein the second movable element is moved closer to the first movable part in such a manner as to intensify a magnetic interaction between the first magnetic portion and the second magnetic portion, as a result of which the first movable part can be set in motion in order to actuate the closing element.

The substantial advantage of the aforementioned embodiment resides in the fact that in the event of a decrease in the ambient air pressure, the mobility of the second movable element first serves to move the second magnetic portion attached thereto in the direction of the first movable element or the first magnetic portion attached thereto and as a consequence the distance between the two magnetic portions is reduced. As a result, an interaction between the magnets is intensified which causes the first magnetic portion to be more greatly attracted by the second magnetic portion. As a consequence, the position of the first movable element changes, whereby the closing element, which is coupled to first movable element, restricts the fuel inlet so as to reduce the quantity of fuel flowing through the fuel chamber for the purpose of adapting the stoichiometric ratio to suit the change in altitude at which the internal combustion engine is utilised.

In the case of a particularly advantageous embodiment, the pressure detection device can comprise the chamber and furthermore the control device can comprise the second movable element. In this case, the second movable element can hermetically seal a chamber, wherein an intermediate space which is open towards the outside environment is provided between the first movable element and the second movable element. Accordingly, a fall in ambient air pressure causes the second movable element to move in the direction of the first movable element, thus achieving the above-described magnetic interaction between the two magnetic portions and the correction of the in-flowing quantity of fuel attained as a result.

A fuel-metering device in accordance with the prior art is characterised in that the adjusting device comprises an active control element which serves to generate the pretensioning force. In this case, a first magnetic portion can be attached to the first movable element, whereas the control element can be formed from an electromagnet which lies opposite the first magnetic portion, and wherein a current flowing through the electromagnet is proportional to the ambient air pressure. Furthermore, the control element can be electrically connected to a performance characteristics controller which adjusts the current, which flows through the electromagnet, in dependence upon the ambient air pressure.

In the case of this embodiment, the performance characteristics controller can output e.g. an analogue or digital electromagnetic signal, by means of which, on the basis of the measured ambient air pressure, it is possible to adjust a suitable through-flow of the electromagnet and thus the stoichiometric composition of the fuel-air mixture appropriate for the air pressure and the type of load.

All of the aforementioned possible embodiments of the fuel-metering device in accordance with the invention have the advantage that the quantity of fuel which is to be supplied to the intake channel to operate the internal combustion engine, can be automatically adjusted to a smaller value in the event of a decrease in the ambient air pressure, in order to ensure a stoichiometrically correct composition for the fuel-air mixture under consideration of the oxygen concentration prevailing in each case.

BRIEF DESCRIPTION OF THE DRAWINGS

These and further features of the invention will be explained in detail hereinunder with the aid of exemplified embodiments and with reference to the Figures, in which.

DETAILED DESCRIPTION OF THE PREFERRED EMBODIMENTS

Figure 1:
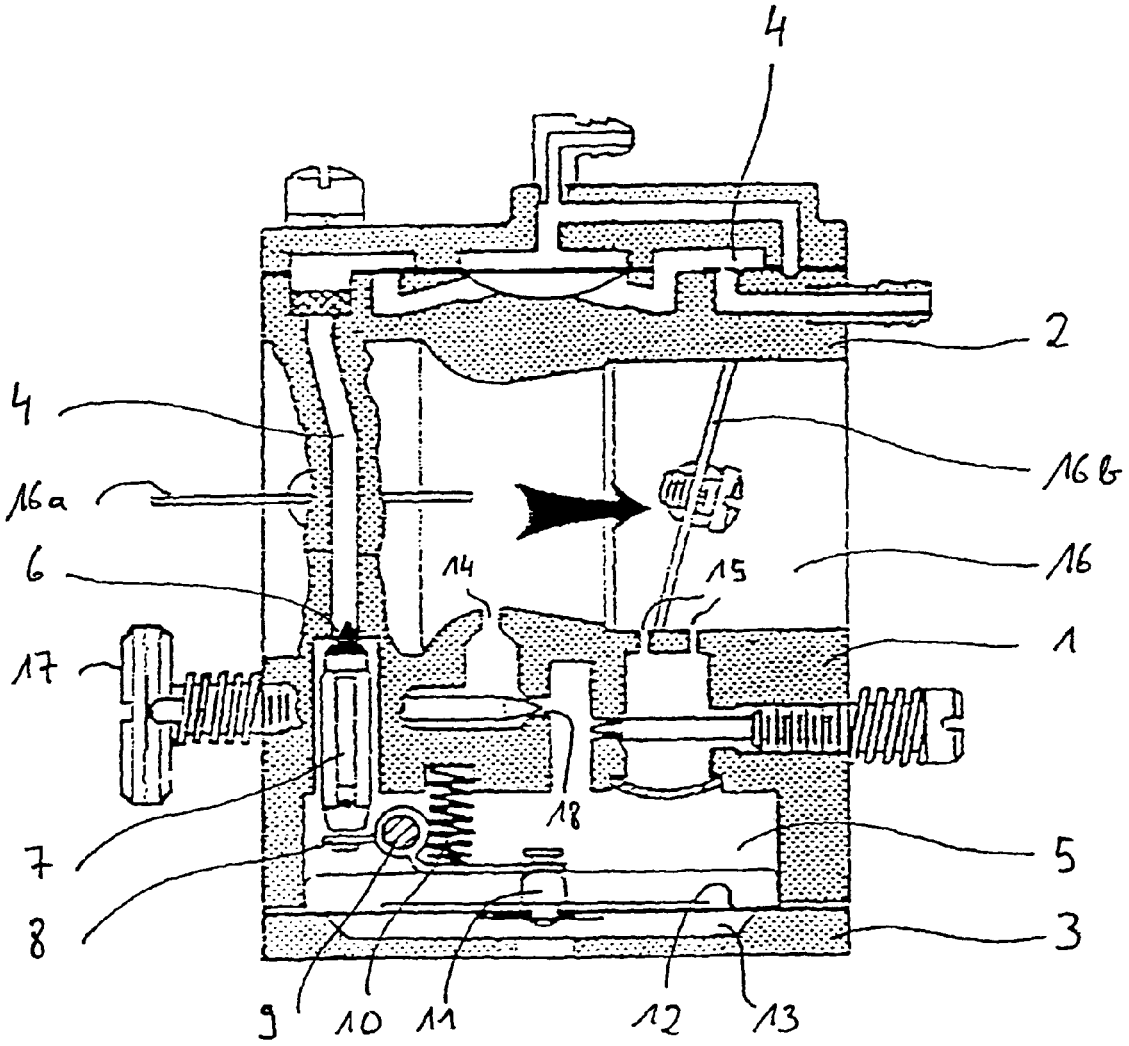
FIG. 1 shows a partial sectional view of a first embodiment of a fuel-metering device in accordance with the invention, wherein in order to explain the functional principle configuration zones are partially incorporated into the sectional plane.
Figure 2:
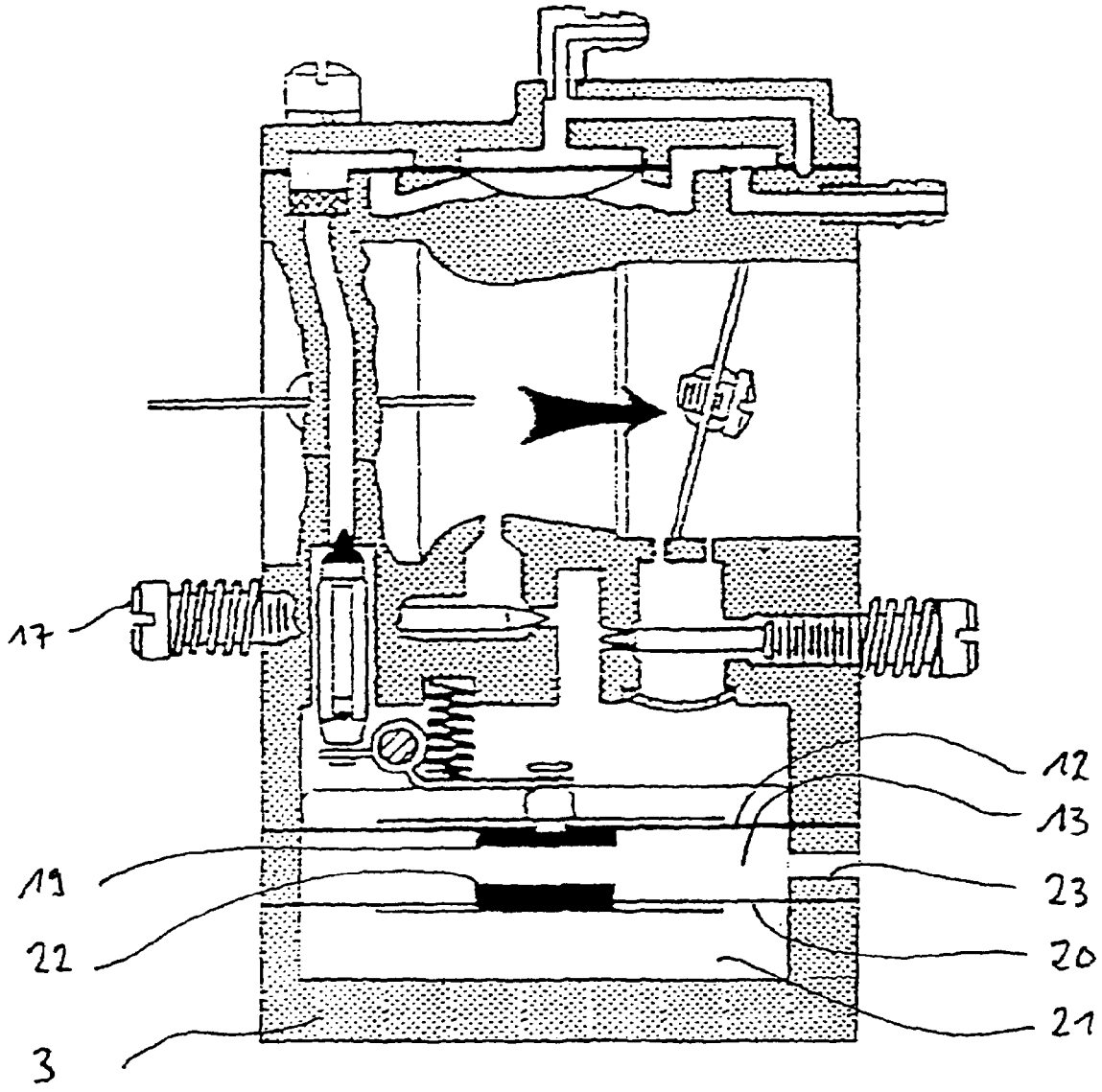
FIG. 2 shows a partial sectional view of a second embodiment of the fuel-metering device in accordance with the invention.

FIGS. 1 to 2 each schematically illustrate a structure of a first to a second embodiment of a fuel-metering device in accordance with the invention. The features which are common to the illustrated embodiments will be explained first hereinunder. The fuel-metering device comprises a housing 1 and an upper cover 2 and a lower cover 3.

Since the basic principle of this type of fuel-metering device, which is also described as a diaphragm carburettor, is known a detailed description thereof will not be provided.

The fuel is fed from a tank, not illustrated, via an inlet channel 4 to a fuel chamber 5. Provided at the end of the inlet channel 4 is a fuel inlet 6 leading to the fuel chamber 5, which fuel inlet can be opened and closed by an inlet needle 7 serving as a closing element.

The inlet needle 7 is [lacuna] by a lever 8 which together form a closing element for opening and closing the fuel inlet 6, wherein the lever 8 can be pivoted about an axis 9 and is influenced by a spring 10 in such a manner that the inlet needle 7 closes the fuel inlet 6.

An upper diaphragm 12 which serves as the first movable element is coupled to the other end of the lever 8 by way of a spigot 11 and separates the fuel chamber 5 from a counter-pressure chamber 13 which communicates with the outside environment. The diaphragm 12 thus forms part of the wall of the fuel chamber 5.

The fuel can pass from the fuel chamber 5 via a main fuel outlet 14 for operation of the internal combustion engine or via no-load fuel outlets 15 to an intake channel 16 where the fuel is mixed with air flowing towards the channel in the direction of the arrow and finally it is supplied as an fuel-air mixture to a combustion chamber, not illustrated, of the internal combustion engine. This supply procedure is effected by the pumping movement of a piston in the combustion chamber which draws in the mixture during an intake stroke. Furthermore, a choke valve 16*a* and a restrictor valve 16*b*, of which the mode of operation is generally known, are disposed in the intake channel 16.

The suction effect achieved with the piston produces a reduction in pressure in the fuel chamber 5, thereby displacing the diaphragm 12—as assisted by the ambient pressure in the counter-pressure chamber acting upon the rear side of the said diaphragm—into the interior of the fuel chamber 5. As a consequence, the lever 8 is pivoted against the effect of the spring 10, so that the inlet needle 7 rises from the fuel inlet 6 and fresh fuel is able subsequently to flow out of the inlet channel 4 or is drawn in by the negative pressure in the fuel chamber 5.

As soon as the pressure is equalised, the diaphragm 12 returns to its starting position as a result of the assistance provided by the spring 10, whereby the fuel inlet 6 is closed once again.

In the case of the first embodiment of the fuel-metering device as illustrated in FIG. 1, a nozzle needle 17 which is disposed in a passage 18 of the housing 1 between the fuel chamber 5 and the intake channel 16 can be adjusted by means of a control device, not illustrated, in such a manner that by means of a consequently varied quantity of fuel supplied to the intake channel 16 it is possible to adjust the fuel mixture to a stoichiometrically correct composition which corresponds to a prevailing oxygen concentration at the respective altitude at which the internal combustion engine is utilised. In other words, means for detecting a change in the ambient air pressure, e.g. pressure sensors, record measurement values of the ambient air pressure and output them to the control device for further processing. After corresponding processing, the control device can generate e.g. digital control signals and output them to control elements, not illustrated, for adjusting the nozzle needle 17.

The second embodiment illustrated in FIG. 2 is modified with respect to the first embodiment to such an extent that the nozzle needle 17 is not connected to a control device and is thus only manually adjustable. Furthermore, an underside of the upper diaphragm 12, which underside is located outside the fuel chamber 5, has a first magnet 19 attached to it. Provided in the region of the lower cover 3 is a lower diaphragm 20 which serves as the second movable element, hermetically seals a chamber 21 and extends in parallel with the upper diaphragm 12. In a position opposite the first magnet 19, a second magnet 22 is provided on an upper side of the lower diaphragm.

The partial sectional view of FIG. 2 illustrates that in the case of this embodiment the counter-pressure chamber 13 is defined by the upper diaphragm 12 and the lower diaphragm 20, wherein the counter-pressure chamber 13 is open towards the outside environment via a compensation line 23. Accordingly, when the internal combustion engine is utilised at relatively high altitudes, i.e. where there is a decrease in the ambient air pressure and thus a decreasing pressure in the counter-pressure chamber 13, the sealed volume in the hermetically sealed chamber 21 causes the lower diaphragm 20 to move with the second magnet 22 attached thereto in the direction of the first magnet 19 attached to the upper diaphragm 12, thus intensifying a magnetic interaction between the two magnets 19, 22. As a result, in the case of a predetermined operating position of the internal combustion engine, in which the upper diaphragm 12 is displaced into the fuel chamber 5 by reason of the suction effect produced by the piston(s), the curvature of the upper diaphragm 12 is reduced as a result of a downwardly directed pretensioning force produced by the magnetic interaction, whereby the fuel inlet 6 is restricted via the lever 8 and by means of the inlet needle 7 and the quantity of fuel supplied is therefore reduced.

In the event of a reduced ambient air pressure it is automatically achieved in the above-described manner that as a result of the described magnetic interaction between the two magnets 19, 22 the fuel-air mixture is fixed to a correspondingly corrected stoichiometric composition with a quantity of fuel reduced in accordance with the lower oxygen content.

Figure 3:
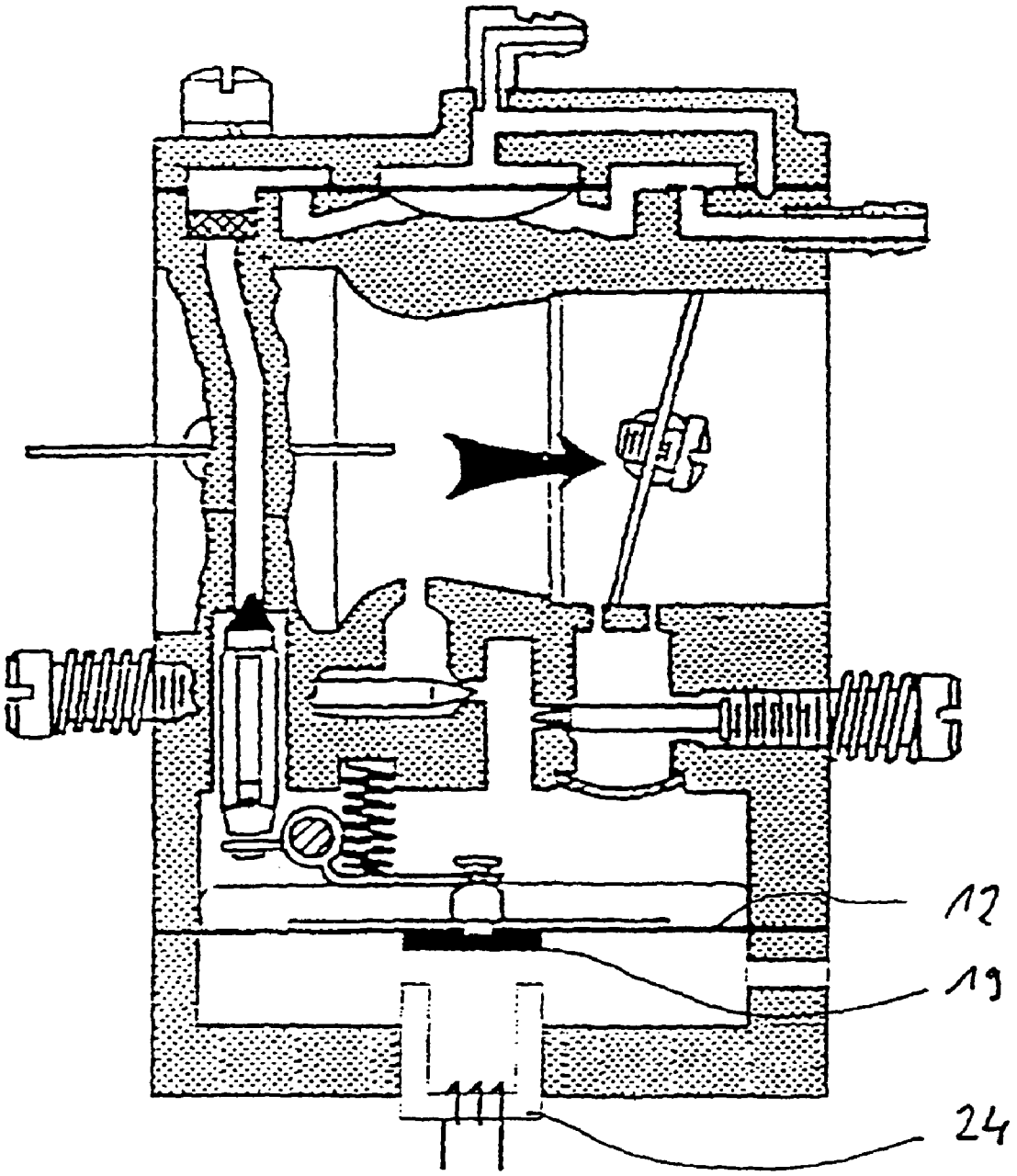
FIG. 3 shows a partial sectional view of an embodiment of a fuel-metering device.

The embodiment illustrated in FIG. 3 is modified with respect to the second embodiment to such an extent that instead of the lower diaphragm 20 with the hermetically sealed chamber 21, an active control element 24 is provided in the region of the lower cover 3. The active control element 24 is introduced into the lower cover 3 in such a manner that it is positioned opposite the first magnet 19 attached to the upper diaphragm 12. The active control element 24 is preferably an electromagnet.

The functional principle of the third embodiment is based upon the fact that in a similar manner to the second embodiment, the electromagnet 24 serves to generate a pretensioning force which acts upon the upper diaphragm 12, in that the electromagnet 24 has a current passing through it, so as to produce a magnetic interaction between the electromagnet 24 and the first magnet 19. The electromagnet 24 is electrically connected to a performance characteristics controller, not illustrated, which adjusts the current, which flows through the electromagnet 24, in dependence upon the respective ambient air pressure such that the fuel-air mixture can thereby be adapted to the corresponding altitude at which the internal combustion engine is utilised. The ambient air pressure can be detected in a suitable manner e.g. by means of a pressure sensor, not illustrated, from which an output signal is input into the performance characteristics controller for further processing. If a corresponding current is applied to the electromagnet 24, the first magnet 19 is attracted by the magnetic interaction in the direction of the electromagnet 24, wherein the effect upon the fuel inlet 6 and the resulting quantity of fuel supplied is the same as in the case of the second embodiment.

In the case of a modified embodiment, it is also possible instead of the first magnet 19 to provide an element which consists of metal and is attached to the upper diaphragm 12 in the same way as the first magnet 19. In this case, this element consisting of metal takes on the same function as the first magnet 19 and guarantees the magnetic interaction explained above.

The embodiment illustrated in FIG. 3 can be modified to such an extent that the electromagnet 24 is disposed within the fuel chamber 5.

In this case, it would be possible to actuate the electromagnet 24 by the performance characteristics controller such that with regard to the desired correction of the quantity of fuel supplied to the intake channel a pretensioning force is generated which counteracts the curvature of the diaphragm 12 accordingly.

Instead of the electromagnet 24 described, it is also possible to use other control elements which—depending upon the embodiment—can also be connected directly to the diaphragm 12. Piezoelectric control elements are the most suitable. However, magnetostrictive, hydraulic or pneumatic control elements which are adapted to the respective application can also be expedient.

I claim:

1. A fuel-metering device having a fuel chamber;

a fuel inlet which can be opened and closed and which leads to the fuel chamber;

at least one fuel outlet leading from the fuel chamber to an intake channel of an internal combustion engine;

wherein part of a wall of the fuel chamber includes a first movable element which can be moved in dependence upon a pressure difference between a pressure in the fuel chamber and an ambient air pressure, the first movable element being coupled to a closing element for opening and closing the fuel inlet; wherein in a position opposite the first movable element, a second movable element is disposed which can be moved relative to first movable element in dependence upon a change in the ambient air pressure, wherein a first magnetic portion is attached to the first movable element and a second magnetic portion is attached to the second movable element, and wherein in the event of a decrease in the ambient air pressure, the second movable element is moved closer to the first movable element in such a manner as to intensify a magnetic interaction between the first magnetic portion and the second magnetic portion, as a result of which the first movable element can be set in motion in dependence upon the ambient air pressure in order to actuate the closing element, so that a quantity of fuel which is to be supplied to the intake channel for a predetermined operating position of the internal combustion engine can be regulated in dependence upon the ambient air pressure.

2. A fuel-metering device as claimed in claim 1, further comprising a chamber which serves as a pressure detection device and which is hermetically sealed by the second movable element, wherein an intermediate space which is open towards the outside environment is provided between the first movable element and the second movable element.

3. A fuel-metering device comprising:

a fuel chamber;

a fuel inlet which can be opened and closed and which leads to the fuel chamber; and at least one fuel outlet leading from the fuel chamber to an intake channel of an internal combustion engine;

wherein part of a wall of the fuel chamber includes a first movable element which can be moved in dependence upon a pressure difference between a pressure in the fuel chamber and an ambient air pressure, the first movable element being coupled to a closing element for opening and closing the fuel inlet;

a through-flow regulating device for adjusting the supply of fuel to the intake channel;

an adjusting device which can be coupled to the through-flow regulating device;

a pressure detection device for detecting a change in the ambient air pressure;

a control device which in dependence upon the pressure detection device serves to operate the adjusting device for actuating the through-flow regulating device, wherein the through-flow regulating device comprises a nozzle needle in a passage between the fuel chamber and the intake channel and a position of the nozzle needle in the passage can be changed via the adjusting device which can be operated by the control device, so that a quantity of fuel which is to be supplied to the intake channel for a predetermined operating position of the internal combustion engine can be regulated in dependence upon the ambient air pressure; and wherein the control device creates a pretensioning force via a magnetic interaction between first and second portions of the fuel-metering device, the first portion being on the first movable element.

4. A fuel-metering device as claimed in claim 3, wherein, in the event of a decrease in the ambient air pressure, the quantity of fuel to be supplied can be adjusted to a smaller value.

5. A fuel-metering device as claimed in claim 4, wherein, in a position opposite the first movable element, a second movable element is disposed which can be moved in dependence upon a change in the ambient air pressure and in the direction of the first movable element, wherein the first magnetic portion is a first magnetic portion attached to the first movable element, and the second portion is a second magnetic portion attached to the second movable element, and wherein in the event of a decrease in the ambient air pressure the second movable element is moved closer to the first movable element in such a manner as to intensify a magnetic interaction between the first magnetic portion and the second magnetic portion, as a result of which the first movable element can be set in motion in dependence upon the ambient air pressure in order to actuate the closing element.

6. A fuel-metering device as claimed in claim 5, wherein the pressure detection device comprises a chamber and the control device comprises the second movable element, the second movable element hermetically seals the chamber, and an intermediate space, which is open towards the outside environment, is provided between the first movable element and the second movable element.

7. A fuel-metering device as claimed in claim 4, wherein the adjusting device comprises an active control element which serves as the second portion and which generate the pretensioning force.

8. A fuel-metering device as claimed in claim 7, wherein the active control element comprises an electromagnet which is positioned opposite the first magnetic portion, and wherein a current flowing through the electromagnet is proportional to the ambient air pressure.

9. A fuel-metering device as claimed in claim 8, wherein the control device comprises a performance characteristics controller, to which the control element is electrically connected, and wherein the pressure detection device comprises a pressure sensor, whose output signal can be processed in the performance characteristics controller, wherein the performance characteristics controller adjusts the current, which flows through the electromagnet, in dependence upon the ambient air pressure.

10. A fuel-metering device as claimed in claim 7, wherein the control element comprises a hydraulic, pneumatic, piezoelectric or magnetostrictive element.

11. A fuel-metering device as claimed in claim 10, wherein the control element can be mechanically connected to the first movable element.

12. A fuel-metering device as claimed in claim 1, wherein in the event of a decrease in the ambient air pressure, the quantity of fuel to be supplied can be adjusted to a smaller value.

* * * * *